United States Patent [19]

Geremia

[11] 4,381,437

[45] Apr. 26, 1983

[54] SWITCHING DEVICE

[75] Inventor: Leo F. Geremia, Wallingford, Conn.

[73] Assignee: Tri-tech, Inc., Waterbury, Conn.

[21] Appl. No.: 223,404

[22] Filed: Jan. 8, 1981

[51] Int. Cl.³ ..... H01H 21/82

[52] U.S. Cl. ..... 200/153 LB; 200/47; 200/153 L; 200/153 T; 74/568 R

[58] Field of Search ..... 74/568 R; 200/38 BA, 200/47, 153 LB, 153 L, 153 T

[56] References Cited

U.S. PATENT DOCUMENTS

| | | | |
|---|---|---|---|
| 2,822,439 | 2/1958 | Schaefer et al. | 200/47 |
| 2,905,777 | 9/1959 | Gayring | 74/568 R |
| 3,106,620 | 4/1959 | Haydon | 200/38 |
| 3,207,860 | 9/1965 | Korsgren et al. | 200/7 |
| 3,267,767 | 8/1966 | Neal | 74/568 R |
| 3,688,593 | 9/1972 | Ustin | 74/568 R |

FOREIGN PATENT DOCUMENTS

| | | |
|---|---|---|
| 1084037 | 9/1967 | United Kingdom . |
| 1447386 | 8/1976 | United Kingdom . |

*Primary Examiner*—John W. Shepperd
*Attorney, Agent, or Firm*—Lee C. Robinson, Jr.

[57] ABSTRACT

A rotary switch comprises a control shaft rotatable clockwise from a neutral position to a first switch actuating position and beyond it to an overtravel position, and counter-clockwise to a second switch actuating position and beyond it to another overtravel position; a centering arrangement for biasing the control shaft to its neutral position; first and second switch mechanisms; a housing enclosing the switch mechanisms; and a switch actuating arrangement. The latter arrangement includes a pair of cams mounted on the control shaft, a pivotally-mounted blade for actuating the first and second switch mechanisms, and first and second cam followers formed on the blade for slidably contacting respective ones of the cams. The cams are preferably formed as plate cams each having a cam finger that is bendable in the circumferential direction, in relation to the control shaft, to adjust the contact position thereof on the respective cam follower.

7 Claims, 6 Drawing Figures

SWITCHING DEVICE

BACKGROUND OF THE INVENTION

1. Field of the Invention:

This invention is directed to a mechanical rotary actuating mechanism, and, more specifically, is directed to a bidirectional, overtravelling, sealed switch and actuator therefor.

2. Brief Description of the Prior Art:

There has been developed an overtravel switch actuating mechanism that is extremely rapid in action and highly efficient. Mechanisms of this character are particularly well suited for use in applications where multiple bidirectional switching operations are required to be made in extremely short periods of time, for example, in the control of the slats on the wing flaps of large jet-propelled aircraft. The device includes a pair of coil torsion springs, one to achieve automatic centering of the switch mechanism, and another to accomodate switch actuation by permitting overtravel of the actuating mechanism beyond a switch actuating position. One such switch actuating mechanism is shown in U.S. Pat. No. 3,207,860, granted Sept. 21, 1965.

The coil torsion springs of the existing device are coupled with four collar-like elements, two of which are affixed to a rotatable actuation shaft, one of which is fixed to a housing, and one of which is rotatable independently of the shaft. For this and other reasons, the over-travel arrangement of the existing device is rather difficult and expensive to construct, and problems also have been encountered in quickly and easily adjusting the switch-actuating positions of the actuating shaft.

OBJECTS AND SUMMARY OF THE INVENTION

It is an object of the present invention to provide an improved bidirectional overtravelling switching device.

It is another object of this invention to provide a switching device which is relatively simple and inexpensive to construct.

It is further object of this invention to provide a switching device in which the switch actuating position of a rotary actuation shaft is easily and positively adjustable.

According to an illustrative embodiment of this invention, a switching device comprises a control shaft rotatable from a neutral position to and beyond a switch actuating position, and a centering arrangement coupled to the control shaft for resiliently biasing the same to the neutral position. A switch unit has a resiliently depressable actuating member that is controlled by an actuating mechanism in response to rotation of the control shaft to the switch actuating position. The switch unit and the switch actuating mechanism are enclosed within a suitable housing.

In accordance with one feature of certain advantagous embodiments of this invention, the switch actuating mechanism comprises a cam coupled to the control shaft; a cam follower slidably contacting the cam to deflect in response to rotation of the cam; and a pivotally-mounted blade coupled with the cam follower for depressing the actuating member of the switch unit when the control shaft has rotated to or beyond its switch actuating position. Preferably, the cam is a plate cam on which a camming member, such as an adjustable cam finger, extends a predetermined radial distance from the axis of the control shaft. The cam follower includes a portion that extends within such radial distance when the control shaft is in its neutral position, but is contacted by the camming member and is urged to a position at such radial distance when the control shaft is rotated to and beyond its switch actuating position. The construction and arrangement of the various components of the switching device are such that the overall manufacturing cost of the device is substantially reduced.

According to another aspect of this invention, in several embodiments the device is bidirectional and includes a pair of switch units each having a resiliently depressable actuating member. The switch actuating mechanism is arranged to depress the actuating members of the switch units in response to rotation of the control shaft to first and second switch actuating positions, respectively.

In these latter embodiments, the switch actuating mechanism comprises a cam arrangement coupled to the control shaft, and first and second cam followers slidably contacting at least a portion of the cam arrangement to deflect when the control shaft is rotated to the respective first and second switch actuating positions. A blade coupled to the first and second cam followers depresses the actuating members of the two switch units when the control shaft has rotated to or beyond its first and second switch actuating positions, respectively.

In certain preferred embodiments of the invention, the cam arrangement includes a first cam plate and a second cam plate arranged axially atop one another on the control shaft. Each of the cam plates has an adjustable cam finger extending generally radially with respect to the control shaft. Radial slots adjacent to the cam finger are adapted to receive a screwdriver or other adjusting tool so that the cam finger can be bent to adjust the circumferential position at which the latter contacts the respective cam follower. At least one of the cam plates has a cut-out formed therein to permit access for the adjusting tool to the slot and cam finger of the other of the cam plates. With this arrangement the switch actuating positions may be individually adjusted in a rapid and straightforward manner merely by bending the corresponding finger.

The foregoing and other objects and advantages of the invention will become more fully apparent from the following description of an illustrative embodiment thereof when read with reference to the accompanying drawings.

DETAILED DESCRIPTION OF A PREFERRED EMBODIMENT

Figure 1:
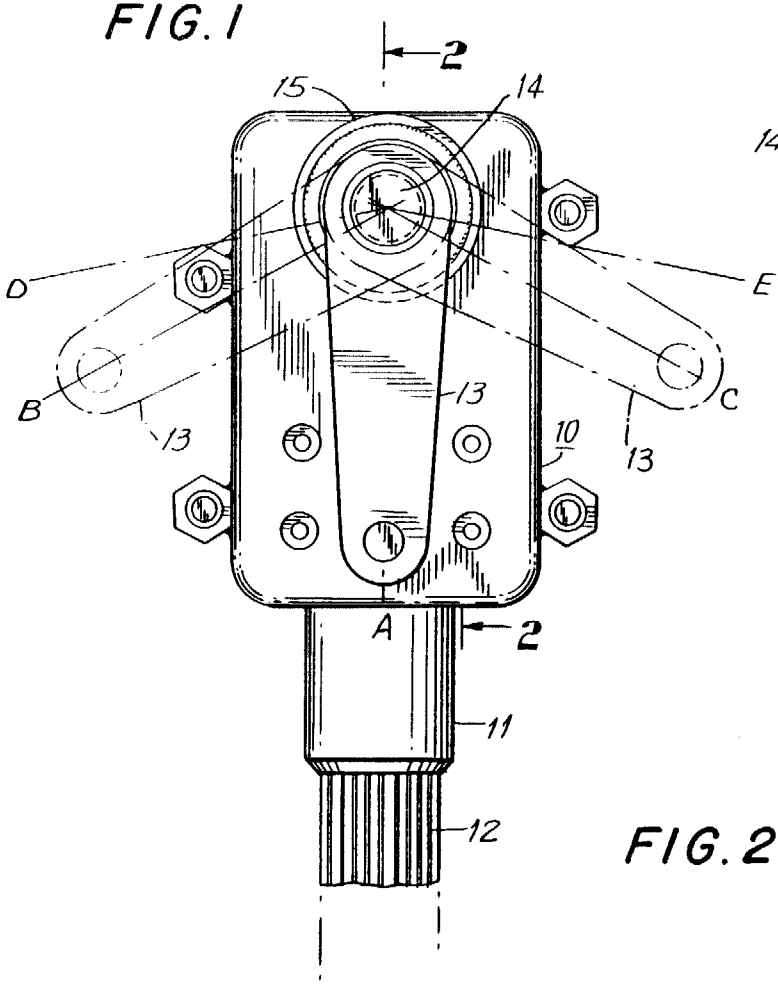
FIG. 1 is a front plan view of a switching device in accordance with an illustrative embodiment of the present invention.

With reference initially to FIG. 1, the switching device genrally includes a rectangular housing 10, a cylindrical cable sleeve 11 at one end of housing 10 in which a wire bundle 12 is potted, and a switch actuating crank 13. Here crank 13 is illustrated in solid lines at a neutral position A, and is rotatable clockwise and counterclockwise to first and second switch actuating positions, B and C respectively, as illustrated in ghost lines. Crank 13 is also rotatable beyond positions B and C to respective overtravel positions D and E. Crank 13 is positioned on a main actuating shaft 14 disposed in a self-centering mechanism 15 near the side of housing 10 remote from cable sleeve 11.

The overtravel feature incorporated in the switching device permits further travel of crank 13 beyond switch actuating positions B and C, and affords a measure of lost motion from position B to position D and from position C to position E. As a result of this feature, rapid multiple switch actuations can be made without damage to any of the delicate internal switching mechanisms.

Self-centering mechanism 15 of the device is similar to that which is described in detail in U.S. Pat. No. 3,207,860, and is shown herein in longitudinal cross-section in FIG. 2 and in lateral cross-section in FIG. 3.

Self-centering mechanism 15 is formed of a cylindrical outer case 16 and a centering torsion spring 17 surrounding main actuating shaft 14. A cylindrical reference collar 18 is affixed to the inner surface of case 16 and has a semicylindrical axial arcuate portion 19 extending toward housing 10. A thermoplastic bushing or sleeve 20 is arranged around shaft 14 for supporting centering spring 17, and an "O" ring 21 is provided between cylindrical reference collar 18 and main actuating shaft 14 to provide an air-tight seal. A collar pin 23 affixes a semicylindrical centering collar 24, disposed between centering spring 17 and axial arcuate portion 19, to main actuating shaft 14 so that collar 24 rotates with the shaft 14.

Figure 3:
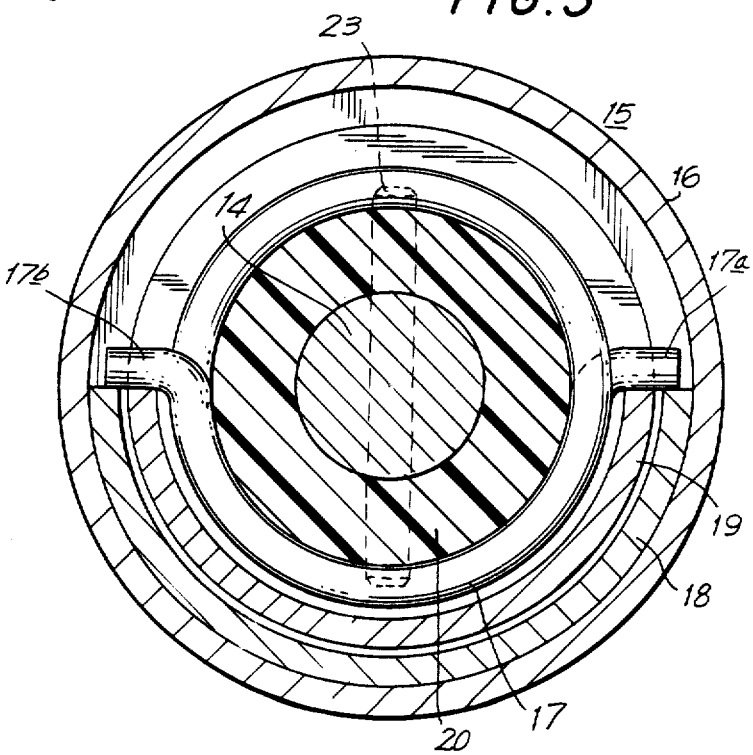
FIG. 3 is a cross-sectional view of the centering mechanism of the device taken along the line 3—3 of FIG. 2.

As better shown in FIG. 3, out-turned free ends **17*a* and 17*b* of torsion spring 17 lie across opposite edges of axial arcuate portion 19 and centering collar 24. Because axial arcuate portion 19 remains fixed with respect to outer cylindrical case 16 while centering collar 24 rotates with main actuating shaft 14, centering torsion spring 17 acts to bias collar 24 and shaft 14 back to the central or neutral position A whenever shaft 14** is rotatably displaced in either the clockwise or counterclockwise direction.

Figure 2:
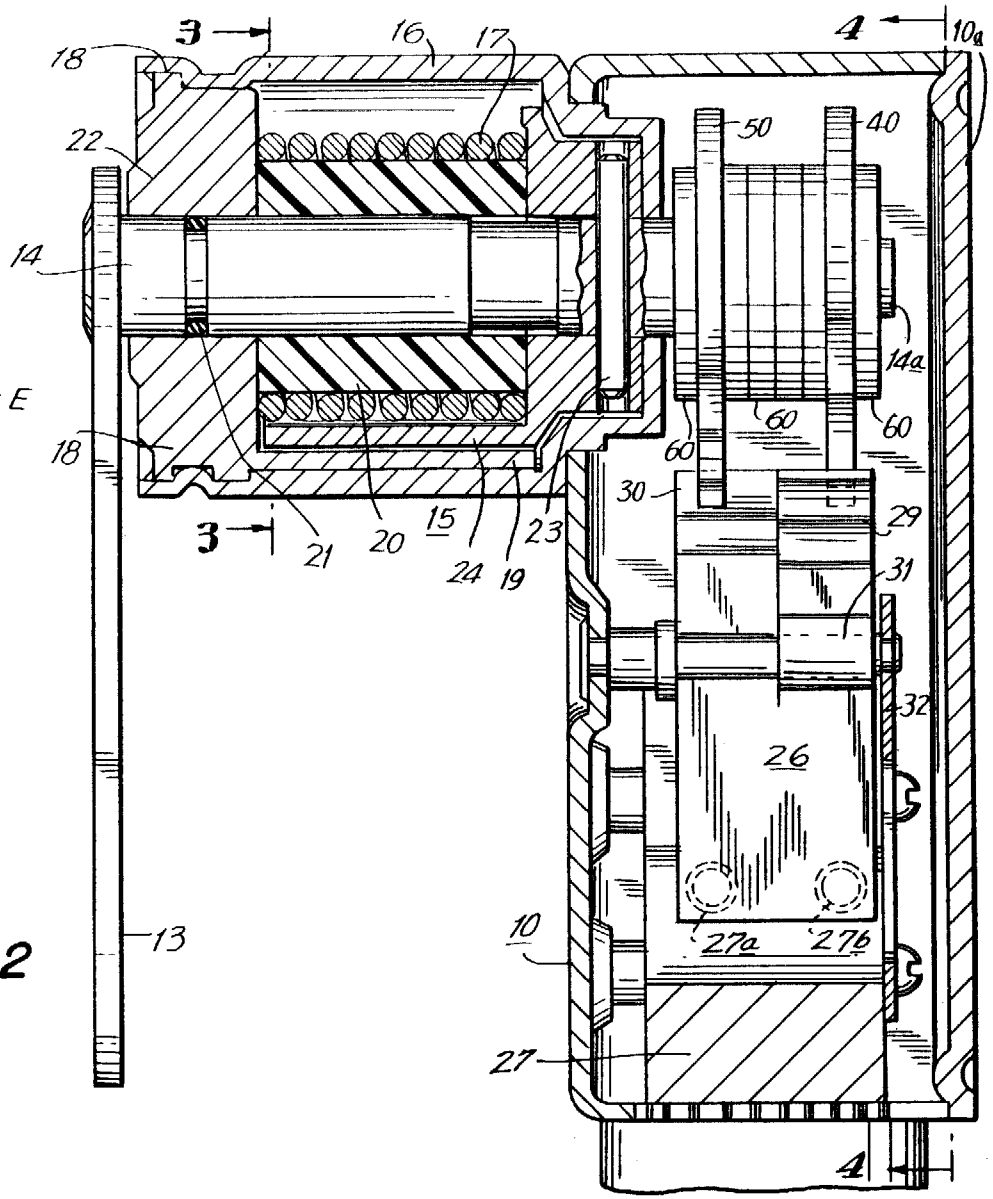
FIG. 2 is a cross-sectional view of the internal mechanism of the device along the line 2—2 of FIG. 1.
Figure 4:
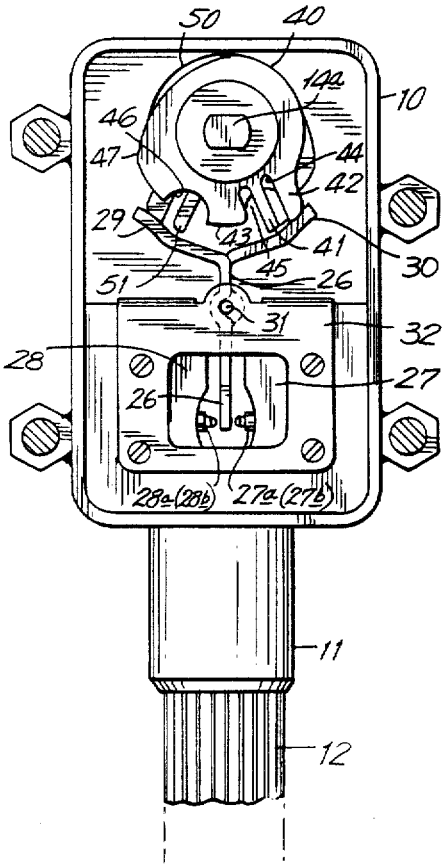
FIG. 4 is a rear plan view of the device cut away along the line 4—4 of FIG. 2.

As further shown in FIG. 2, housing 10 includes a back wall **10*a*, which can be welded to make the switching device airtight, but which is omitted in the rear plan view of FIG. 4**.

The switching device further includes a pivotally mounted blade 26 that rotatable to actuate either a first switch 27 or a second switch 28. Normally, there are provided on each switch 27 and 28 a pair of push buttons **27*a*, 27*b*, and 28*a*, 28*b*, and blade 26 actuates switches 27 and 29 by depressing push buttons 27*a* and 27*b* or 28*a* and 28*b*. The end of blade 26 remote from push buttons 27*a* , 27*b*, 28*a*, 28*b* is split into a back and front portion and these are bent to the left and to the right (FIG. 4) to form first and second cam followers 29 and 30, respectively. A pivot pin 31 mounted in blade 26 is held at one end in case 10 and at the other end in a switch-covering plate 32. A first cam plate 40 and a second cam plate 50 are complementarily arranged one atop the other on a key portion 14*a* of main actuating shaft 14. Cam plates 40 and 50 are axially separated from one another by spacing devices 60 (FIG. 2). Cam followers 29 and 30 are correspondingly axially displaced so as to contact cams 40 and 50**, respectively.

As shown in FIG. 4, blade 26 and cam followers 29 and 30, as viewed from the back, are together generally formed as a tee (i.e., a T-shaped member) with blade 26 being the stem and cam followers 29, 30 each being an arm of the tee. Here, pivot pin 31 is disposed in the stem of the tee. The construction of cam plates 40 and 50 is substantially identical, so that cams 40 and 50 are congruent and reversed with respect to each other and thus act in a complementary fashion when shaft 14 is rotated.

Figure 5:
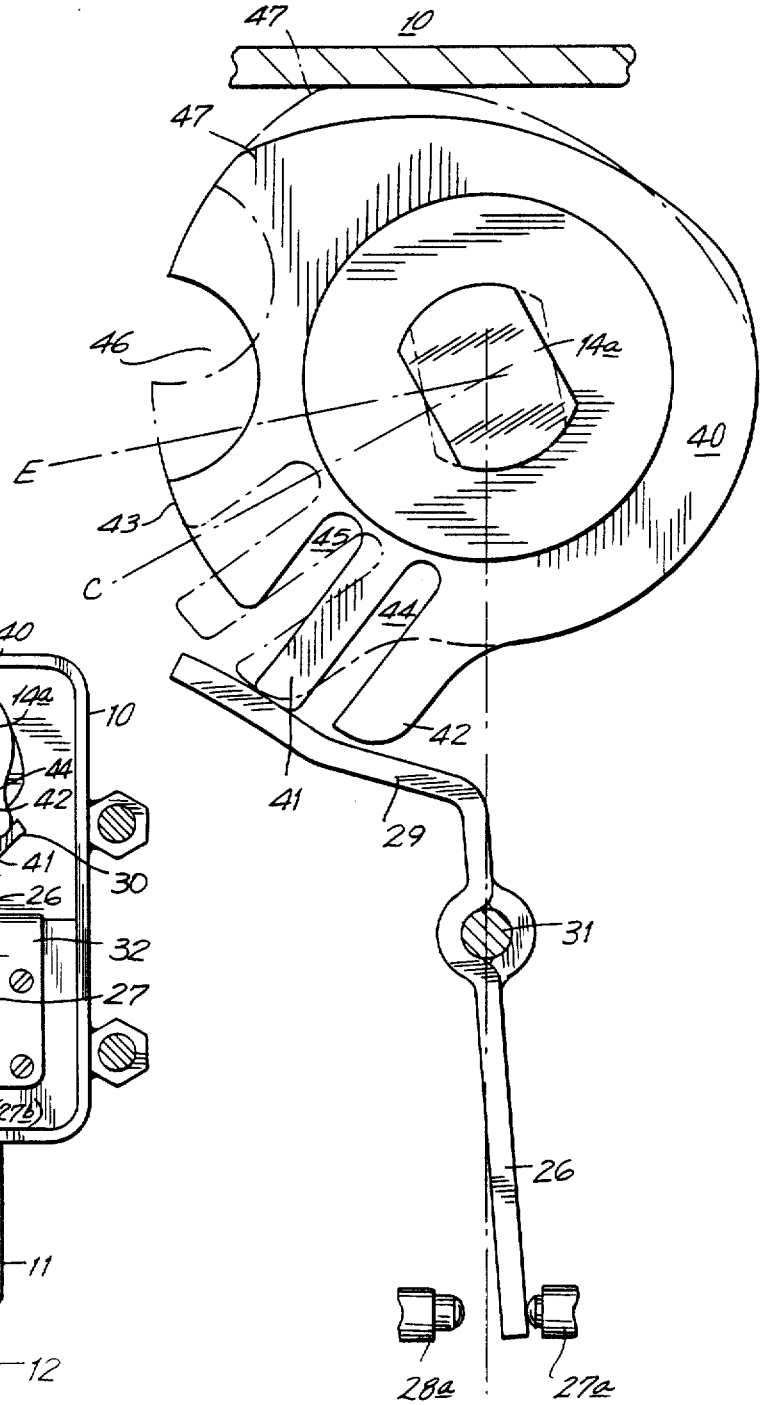

As shown in more detail in FIG. 5, first cam plate 40 includes a camming portion having an adjustable cam finger 41 and a fixed cam finger 42 arranged after finger 41 in the direction of rotation of cam plate 40. A radially smaller portion 43 of cam plate 40 is located in advance of finger 41, and slots 44 and 45 separate finger 41 from each of finger 42 and portion 43, respectively. Finger 41 is connected at its base to the central portion of cam plate 40 and is adapted so that the free end thereof contacts cam follower 29 to displace the latter when crank 13 and shaft 14 are rotated to switch actuating position C. A workman can easily adjust the circumferential position at which the free end of cam finger 41 contacts cam follower 29 by inserting a screwdriver or other adjusting tool into one or the other of slots 44 and 45 to bend finger 41.

An access notch 46 is also provided in cam plate 40. Access notch 46 permits access for the adjusting tool to adjust the position of a complementary adjustable cam finger 51 provided on second cam plate 50.

Also provided on cam plate 40 is a stop or abutment 47, here formed as a portion of cam plate 40 which has a radially greater extent than the distance from the axis of shaft 14 to wall 10.

Figure 6:
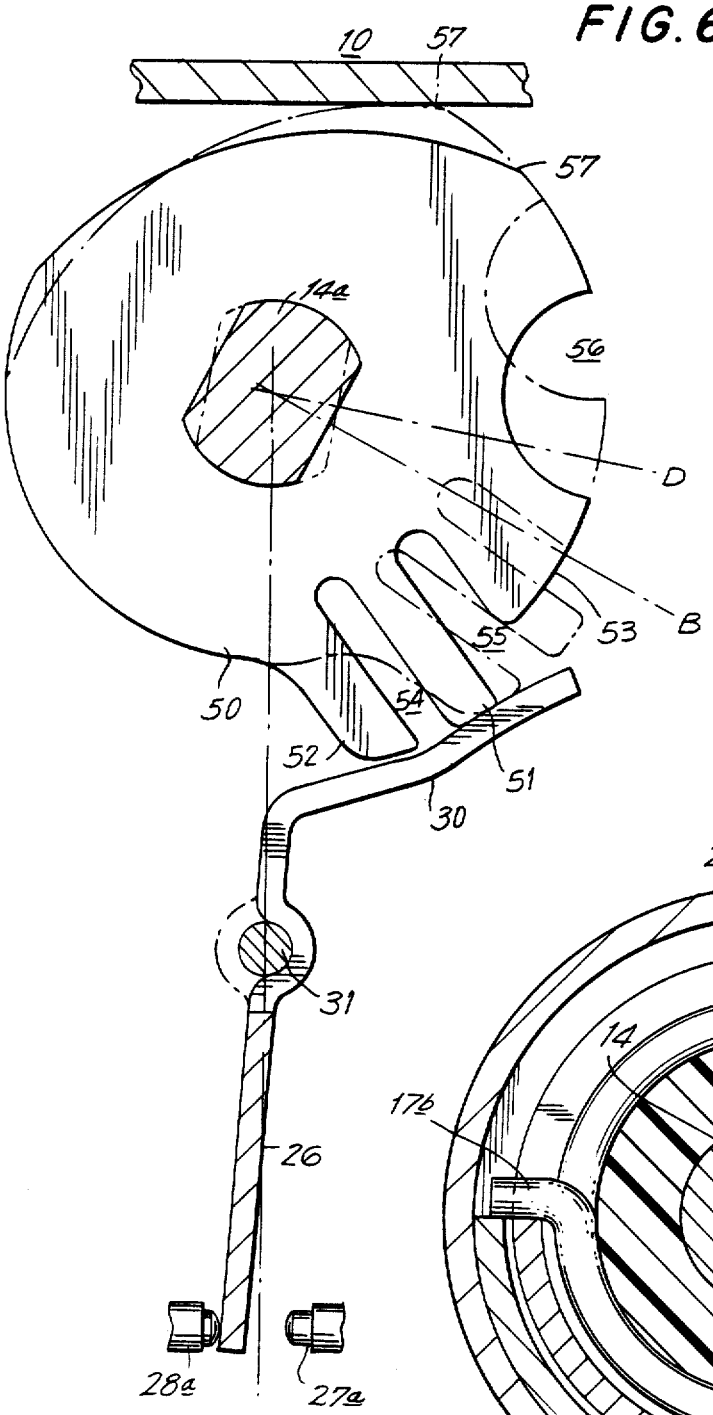
FIG. 5 and 6 are plan views illustrating the operation of first and second cams and cam followers, respectively, of the device.

As shown in FIG. 6, second cam plate 50 is arranged to be congruent with cam plate 40, but is reversed in respect to it. Cam plate 50 includes adjustable finger 51, a fixed finger 52, a radially smaller portion 53, and slots 54, 55. Second cam plate 50 also has an access notch 56 and a stop or abutment 57.

In FIGS. 5 and 6, the arrangement of each of respective cam followers 29 and 30 with blade 26 generally forms an ell, (i.e., an L-shaped arrangement) with blade 26 arranged as the stem of the ell and cam followers 29 and 30 each forming a foot of the respective ell.

The operation of the switching device will be explained with reference to FIGS. 4, 5, and 6. Initially, when crank 13 is in neutral position A (FIG. 1), cam plates 40 and 50 are also in their neutral positions as shown in FIG. 4. When crank 13 is rotated in the counterclockwise direction (i.e. clockwise as viewed in FIGS. 4–6) to switch actuating position C, finger 41 slides into contact with cam follower 29, thereby moving the latter and rotating blade 26 to depress push buttons **27*a* and 27*b*. When crank 13 is rotated beyond position C toward overtravel position E, cam plate 40 rotates to the position shown in ghost lines in FIG. 5, and fixed finger 42 contacts cam follower 29. The latter is held in position so that blade 26 continues to depress push buttons 27*a* and 27*b*. At position E, stop 47 comes to rest against wall 10, thereby limiting the overtravel of cam plate 40**.

Cam follower 29 is formed as a bent foot portion of an ell, and the same extends within the radial extent of fingers 41, 42 when crank 13 and actuating shaft 14 are in neutral position A, and is urged out to such radial extent, but not beyond, when crank 13 and actuating shaft 14 are turned to and beyond switch actuating position C. Thus, the rotation of crank 13 and shaft 14 to position C will positively actuate switch 27, but rotation beyond position C toward position E will not damage switch 27.

The operation of second cam plate 50 and second cam follower 30 is substantially identical to that of first cam plate 40 and first cam follower 29. That is, when crank 13 and shaft 14 are rotated clockwise to switch actuating position B and beyond it to overtravel position D, adjustable cam finger 51 first slides into contact with cam follower 30 and moves the same so that blade 26 depresses push buttons **28*a* and 28*b*. Then, fixed cam finger 52 moves into contact with cam follower 30 to maintain blade 26 against push buttons 28*a* and 28*b*. Thereafter, when crank 13, shaft 14, and cam plate 50 reach overtravel position D, as shown in ghost lines in FIG. 6, abutment 57 contacts against wall 10** and prevents further rotation.

Of course, when crank 13 is released, centering mechanism 15 urges the latter, together with cam plates 40 and 50, from switch actuating position B or C or from overtravel position D or E, back to neutral position A.

Switching devices constructed according to the present invention afford a considerable cost savings and ease of manufacture as compared with prior switches, without the sacrifice of strength or reliability.

Further, while a bidirectional switch has been illustrated and described hereabove, the present invention also is favorably applied to a switch actuable in a single direction only.

Furthermore, while the mechanism of this invention has been illustrated by a specific embodiment to be coupled to electrical switches, the same also is favorably applied to actuate mechanical, hydraulic, or other control devices.

Still further modifications and variations may be achieved without departing from the scope and spirit of the present invention.

What is claimed is:

1. In a switching device comprising a control shaft rotatable from a neutral position to and beyond a switch actuating position, centering means coupled to said control shaft for resiliently biasing the same to said neutral position, a switch mechanism having a resiliently depressible actuating member, and switch actuating means for depressing said actuating member in response to rotation of said control shaft to said switch actuating position; the improvement wherein said switch actuating means comprises a cam, coupled to said control shaft, including a cam finger extending generally radially with respect to the axis of said control shaft and having a free end remote from said control shaft and a base end coupled to said control shaft; a cam follower slidably contacting said cam finger to deflect in response to rotation of said cam; and linkage means coupled with said cam follower for depressing the actuating member of said switch mechanism when said control shaft has rotated to or beyond its switch actuating position.

2. A switching device according to claim 1, wherein the circumferential position of said free end of the cam finger relative to said control shaft is adjustable by bending said cam finger.

3. In a switching device comprising a control shaft rotatable from a neutral position to and beyond a switch actuating position, centering means coupled to said control shaft for resiliently biasing the same to said neutral position, a switch mechanism having a resiliently depressible actuating member, and switch actuating means for depressing said actuating member in response to rotation of said control shaft to said switch actuating position; the improvement wherein said switch actuating means comprises a cam coupled to said control shaft and including an adjustable cam finger extending generally radially with respect to the axis of said control shaft having a free end radially distant from said control shaft and a base end coupled to said control shaft, and a fixed cam finger disposed circumferentially behind said adjustable cam finger; a cam follower slidably contacting said cam to deflect in response to rotation of said cam, said free end of said adjustable finger contacting said cam follower to move the same when said control shaft is rotated to said switch actuating position and said fixed cam finger contacting said cam follower when said control shaft is rotated beyond said switch actuating position; and linkage means coupled with said cam follower for depressing the actuating member of said switch mechanism when said control shaft has rotated to or beyond its switch actuating position.

4. In a switching device comprising a control shaft rotatable clockwise from a neutral position to and beyond a first switch actuating position and counterclockwise from said neutral position to and beyond a second switch actuating position, centering means coupled to said control shaft for resiliently biasing the same to said neutral position, first and second switch mechanisms each having a resiliently depressible actuating member and positioned with their respective actuating members facing one another, and switch actuating means for depressing the actuating member of said first and second switch mechanisms in response to rotation of said control shift to its first and second switch actuating positions, respectively; the improvement wherein said switch actuating means comprises a cam arrangement coupled to said control shaft and including first and second cam fingers each extending generally radially with respect to the axis of said control shaft and having a free end radially remote from said control shaft and a base end coupled to said control shaft; first and second cam followers slidably contacting at least the free ends of said first and second cam fingers, respectively, to deflect in response to rotation of said cam arrangement when said control shaft is rotated to said first switch actuating position and to said second switch actuating position respectively; and linkage means coupled to said first and second cam followers for depressing the respective actuating member of said first and second switch mechanisms when said control shaft has rotated to or beyond its first and second switch actuating positions, respectively.

5. A switching device according to claim 4, wherein the circumferential portion of said free end of the cam finger relative to said control shaft is adjustable by bending said cam finger.

6. A switching device according to claim 5, further comprising first and second fixed cam fingers disposed circumferentially behind the first-mentioned cam fingers to contact the respective cam follower after said first-mentioned cam finger when said control shaft is rotated beyond its first and second switch actuating positions, respectively.

7. In a switching device comprising a control shaft rotatable clockwise from a neutral position to and beyond a first switch actuating position and counterclockwise from said neutral position to and beyond a second switch actuating position, centering means for resiliently biasing said control shaft to said neutral position; first and second switch mechanisms each having a resiliently depressible actuating member, and switch actuating means for depressing the actuating member of said first and second switch mechanisms in response to rotation of said control shaft to its first and second switch acutating positions, respectively; the improvement wherein said switch actuating means comprises a first cam follower and a second cam follower; linkage means coupled to said first and second cam followers for depressing the actuating member of a respective one of said first and second switch mechanisms in response to deflection of said first and second cam followers; and a cam arrangement coupled to said control shaft and including a first cam plate and a second cam plate arranged axially atop one another on said control shaft, each of said first and second cam plates having camming means thereon for slidably contacting a respective one of said cam followers, each said camming means including a cam finger extending generally radially with respect to said control shaft, said cam plates having radial slots therein adjacent said cam finger adapted to receive an adjusting tool for bending said cam finger to adjust the circumferential position at which the latter contacts the respective cam follower, and at least one of said cam plates having a cutout formed therein to permit access for said adjusting tool to the slots and cam finger of the other of said cam plates.

* * * * *